United States Patent [19]

Arneson

[11] 3,989,171

[45] Nov. 2, 1976

[54] CARTON WITH POUR SPOUT

[75] Inventor: Edwin L. Arneson, Hillsdale, N.J.

[73] Assignee: Federal Paper Board Company, Inc., Montvale, N.J.

[22] Filed: Sept. 29, 1975

[21] Appl. No.: 617,516

[52] U.S. Cl. ..... 222/541; 222/528; 229/7 R

[51] Int. Cl.[2] ..... B65D 83/06

[58] Field of Search ..... 222/528, 531, 535, 541; 229/7, 17, 51 D

[56] References Cited

UNITED STATES PATENTS

| | | | |
|---|---|---|---|
| 523,321 | 7/1894 | Bradfield | 229/7 R |
| 1,837,750 | 12/1931 | Becker | 229/51 D X |
| 1,961,055 | 5/1934 | Lewin | 222/541 X |
| 2,249,574 | 7/1941 | Morrison | 222/541 X |
| 2,546,052 | 3/1951 | Wilkins | 222/528 |
| 2,574,720 | 11/1951 | Trout et al. | 222/541 |
| 3,216,609 | 11/1965 | Bogert | 222/541 |

FOREIGN PATENTS OR APPLICATIONS

| | | | |
|---|---|---|---|
| 82,977 | 1/1954 | Norway | 222/531 |

*Primary Examiner*—Davis T. Moorhead
*Attorney, Agent, or Firm*—Guy A. Greenawalt

[57] ABSTRACT

A carton structure adapted to be fabricated of paperboard or other suitable foldable, sheet-like material and provided with a dispensing opening having a pouring spout arrangement which comprises an insert positioned on an inside wall near the top end of the carton with a pull tab extending through a transverse slot in the wall at the top of an area which is defined, at least, along one side, by a tearing line, which may be broken by pulling outwardly on the tab, and along an adjoining side by a hinge line thereby enabling the wall portion within the area to be hinged outwardly along with a wall portion of the insert, the latter being hingedly connected to a side wall forming portion of the insert which is pulled outwardly to a position where it forms a side wall of the pouring spout.

10 Claims, 12 Drawing Figures

FIG. 1
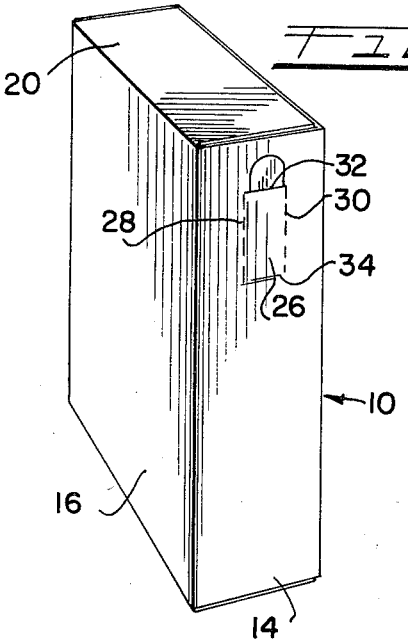
FIG. 2
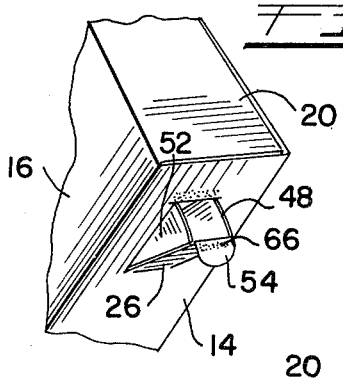
FIG. 3
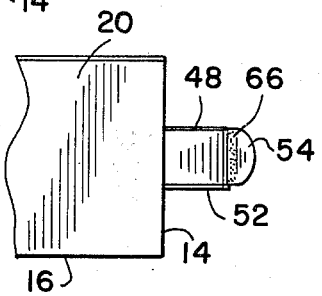
FIG. 4
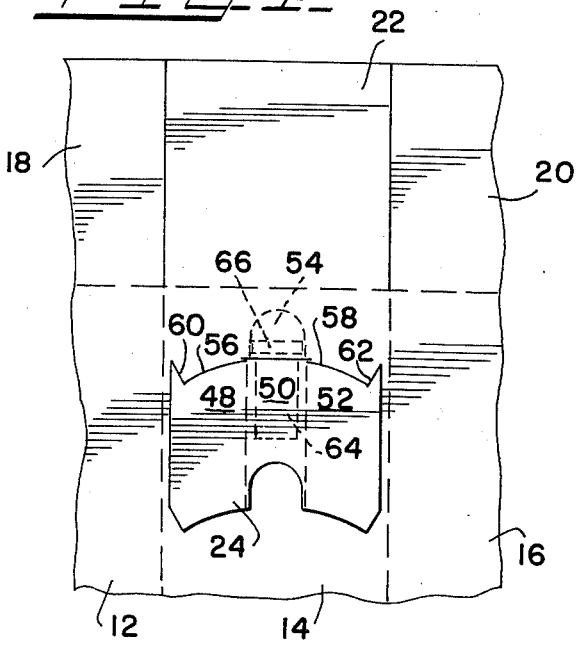
FIG. 5
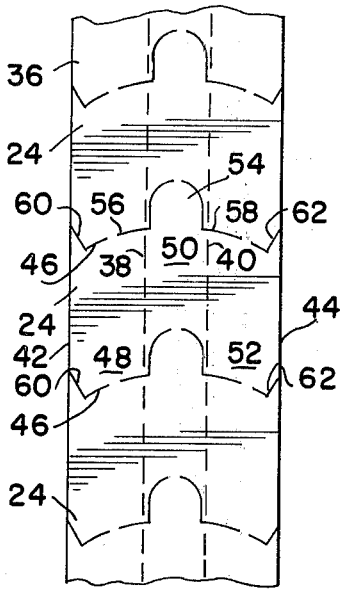
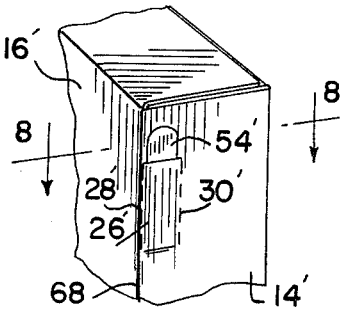
FIG. 6
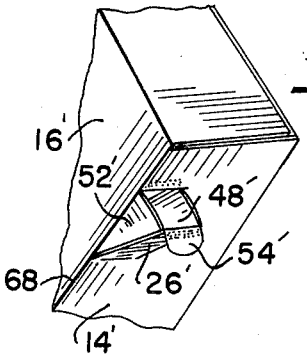
FIG. 7

FIG. 8
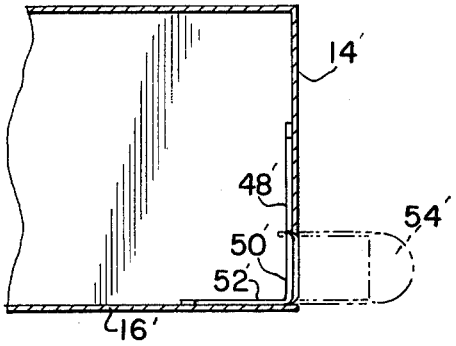
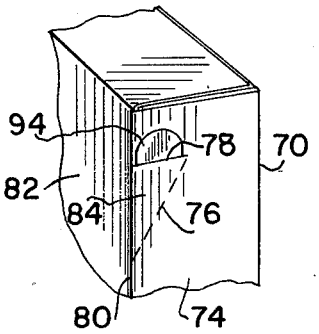
FIG. 9
FIG. 10
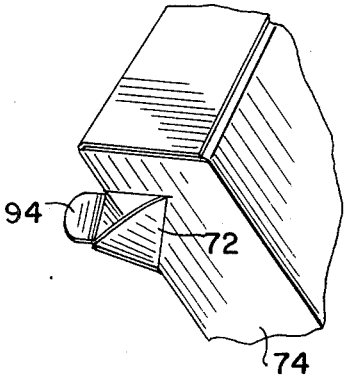
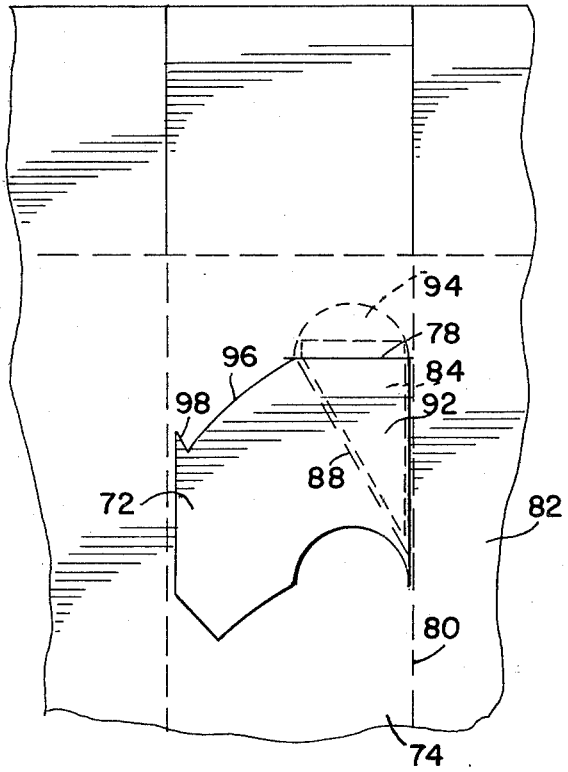
FIG. 11
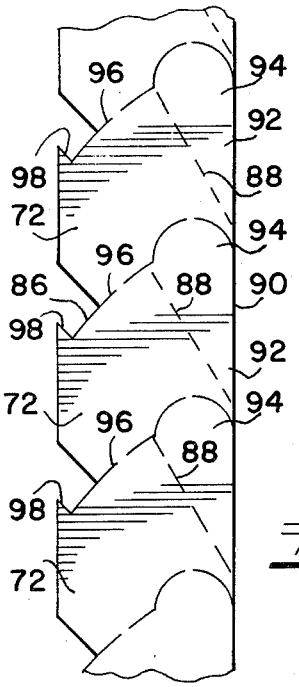
FIG. 12

CARTON WITH POUR SPOUT

This invention relates to carton structures which are especially adapted for the packaging of products of a flowable character and is more particularly concerned with improvements in a carton having a pour spout arrangement in a wall thereof which enables the product to be conveniently dispensed through a relatively small reclosable opening in the wall.

Numerous arrangements have been proposed heretofore for packaging products of a flowable nature which it is desirable to be able to dispense in a convenient manner when the product is needed. For example, some food products, such as, sugar, salt, certain cereals and the like, are frequently marketed in cartons having a dispensing arrangement which is formed by mounting in an aperture in a wall thereof, a bent metal spout forming member with the latter arranged so as to substantially cover the aperture in the closed position and to hinge to an open position enabling the product to be dispensed through the resulting wall opening. The metal spout member and the labor involved in mounting it in the opening increases substantially the cost of the packaging operation and limits the field of use of such packages. Where a seal is required, the application of an overlying sealing patch further increases the cost of the package and discourages the use of this arrangement for packaging a number of products which would be more conveniently handled if marketed in this type package. Also, some objections have been raised to the use of the metal spout member which are based on safety hazards and ecology. A general object, therefore, of the present invention is to provide a carton having an improved pouring spout arrangement which can be produced in a more economical manner than similar arrangements heretofore employed, which can be operated with less risk of injury to the user, and which has other advantages not obtainable with previously developed pouring spout designs.

A more specific object of the invention is to provide a carton formed of foldable paperboard or similar sheet or web material with a dispensing arrangement of the pouring spout type which can be readily incorporated in the carton during fabrication of the carton in collapsed condition.

A still more specific object of the invention is to provide a dispensing arrangement for incorporation in a carton formed of paperboard or similar foldable sheet material which comprises a pouring spout member of the same or similar material and which is cut and scored so as to enable it to be secured on the blank for forming the carton prior to or during the fabrication of the carton in collapsed condition.

Another object of the invention is to provide a carton of paperboard or similar foldable material with a dispensing opening which is initially closed by an insert which is cut and creased to form wall panels and a pull tab and which is arranged on an inner wall portion with the pull tab exposed on the outer wall for manually drawing portions of the insert into the opening and forming therein a pour spout for convenience in dispensing the carton contents through the opening.

A further object of the invention is to provide an improved dispensing opening for a carton formed of paperboard or similar material wherein the wall area for the opening is initially covered by an insert secured on the inner face of the wall and having a pull tab member extending through a slit in the wall which defines one edge of the opening and which enables the wall area to be torn and hinged so as to form the opening and to draw portions of the insert into the opening thereby forming a pour spout.

To this end the invention, as claimed herein, is embodied in a carton of paperboard or similar foldable sheet material which is adapted to be fabricated in collapsed tubular form and which is provided on the inner face of a wall thereof with an insert which is also of foldable material and which includes a pull tab member adapted to extend through a slot in the wall which defines one edge of a dispensing opening resulting when the pull tab is pulled outwardly and an area to which the insert is secured is thereby torn, enabling the area to hinge about an edge of the opening and to draw portions of the insert into the opening so as to form therein a pour spout for convenience in dispensing the carton contents through the opening.

The aforesaid objects and other objects and advantages of the invention will become more apparent when reference is made to the accompanying detailed description of the preferred embodiment of the invention and several modifications thereof which are set forth therein, by way of example, and shown in the accompanying drawings wherein like reference numerals indicate corresponding parts throughout.

FIG. 1 is a perspective view of a carton in set-up and closed condition with a dispensing arrangement in the form of a reclosable opening having a pouring spout incorporated therein which embodies the principal features of the invention;

FIG. 2 is a fragmentary perspective view showing the top corner portion of the carton of FIG. 1 with the pouring spout in open position;

FIG. 3 is a fragmentary top plan view showing the carton of FIG. 1 with the pouring spout in open position;

FIG. 4 is a fragmentary plan view, to an enlarged scale, showing a portion of a cut and creased blank which has been prepared for fabricating the carton of FIG. 1 with a pouring spout insert member secured on the inside face of a side wall forming panel;

FIG. 5 is a plan view showing a strip of material which has been cut and creased to provide a plurality of pouring spout insert members;

FIG. 6 is a fragmentary perspective view showing a top corner portion of a carton with a pouring spout in a different location in the side wall;

FIG. 7 is a fragmentary perspective view similar to FIG. 2 showing the top corner portion of the carton of FIG. 6 with the pouring spout in open position;

FIG. 8 is a fragmentary cross section, to an enlarged scale, taken on the line 8—8 of FIG. 6;

FIG. 9 is a fragmentary perspective view of the top corner portion of a carton with a modified form of the pouring spout incorporated in the top portion of the side wall;

FIG. 10 is a fragmentary view similar to FIG. 9 showing the pouring spout in open position;

FIG. 11 is a fragmentary view, to an enlarged scale, showing a portion of a blank which is cut and scored preparatory to forming the carton of FIG. 9 with a pouring spout member secured on the inside face of a side wall forming panel; and FIG. 12 is a plan view showing a strip of material which has been cut and creased to provide a plurality of pouring spout insert members shown in FIG. 11.

The basic carton structure which is illustrated in the drawings is formed from a paperboard blank of typical construction, except for the provision of a tear out area in a wall panel in which a pouring spout arrangement is to be incorporated. In the several forms illustrated, the pouring spout structure is incorporated in a side wall adjacent the top portion thereof and the panel is cut and scored to accommodate the same. The exact size and shape of the carton and the character of the blank which is cut and creased or shaped to provide the basic carton structure may be varied considerably. Also, it will be understood that the exact location of the pouring spout is a matter which may be dictated, at least in part, by the characteristics of the product which is to be enclosed in the carton and which is adapted to be dispensed through the opening in which the pouring spout is mounted. While the pouring spout will be incorporated in a single thickness wall, in some special situations, it may be mounted in a multi-thickness wall area.

Referring first to the form of the invention illustrated in FIGS. 1 to 5 of the drawings, the carton 10 may be formed of foldable sheet material, for example, a blank of paperboard stock of suitable weight which is cut and scored to provide foldably connected side wall panels, three of which are indicated at 12, 14 and 16 in FIG. 4, and a top or end wall structure comprising closure flaps 18 and 20 which are hinged to the side wall panels 12 and 16 and a pair of dust flaps 22 which are hinged to the intervening side wall panels, one of which, as indicated in FIG. 4, is hinged to the side wall panel 14. The end panels 22, 20 and 18 are folded inwardly to the closed position shown in FIG. 1 when the carton is set up and the end closed.

The pouring spout arrangement is incoporated in the top portion of the side wall forming panel 14 by securing on the inside face of the panel 14 a specially prepared insert 24, as shown in FIG. 4. The panel 14 is cut and scored to provide a tear out or tear open area 26 which is defined by a pair of transversely spaced, parallel tear lines 28 and 30, a transverse slit 32 which extends between the top ends of the tear lines 28 and 30 and a transverse hinge forming score line 34 which extends between the bottom ends, enabling the area 26 to be torn loose on the lines 28 and 30 for outward and downward hinging on the score line 34 so as to provide a dispensing opening in the wall.

The insert 24 may be conveniently formed, without waste, by cutting a plurality thereof from a strip or web 36 of stock material as shown in FIG. 5. The web 36 is creased or scored on parallel, hinge forming lines 38 and 40, which are spaced inwardly of side edges 42 and 44, and cut on longitudinally spaced, transverse lines 46 resulting in a plurality of indentical insert members 24. The longitudinal score lines 38 and 40 divide each insert 24 into three panels 48, 50 and 52. The transverse cutting lines 46 have a configuration which results in a pull tab forming extension 54 on the center panel 50 and curved top edge portions 56 and 58 which are bowed in the direction of the pull tab 54 and which extend laterally of the insert from the pull tab 54 to points spaced a short distance inwardly of the side edges 42 and 44 and at the innermost ends of short line portions 60, 62 which line portions 60, 62 extend in diverging relation to the side edges 42 and 44 and in the same direction as the pull tab 54 in the direction lengthwise of the strip.

The insert 24 is positioned on the inside face of the carton wall 14 with the pull tab portion 54 extending through the transverse slit 32 and the insert panel 50 engaging the tear out panel 26 and secured thereto by an adhesive indicated at 64. The transverse spacing of the hinge lines 38 and 40 is approximately the same or slightly less than the transverse spacing of the tear lines 28 and 30 so that upon pulling the tab 54 outwardly and tearing on the lines 38 and 40 the panels 44 and 48 are hinged about the lines 38 and 40 and are drawn through the opening formed between the tear lines 28 and 30 so as to form the side walls of the spout when it is in the open position for dispensing the contents, as shown in FIGS. 2 and 3. The outward movement is limited by the abutment forming edges resulting from cutting the insert on the cutting line portions 60 and 62. The pull tab 54 may be adhered to the surface of the wall 14 initially, as indicated at 66, to further seal the opening and guard against accidental dislodgement of the tab.

An alternative arrangement of the pouring spout is shown in FIGS. 6 to 8. The blank construction for the basic carton structure is the same as in the form shown in FIGS. 1 to 5 except for the location of the tear out area 26′ in the wall panel 24′ in which the pouring spout arrangment is mounted. The two parallel, spaced tear lines 28′ and 30′ are shifted laterally of the panel 14′ so that the one tear line 28′ coincides with or is closely adjacent the hinge line 68 which connects the wall panels 14′ and 16′. The pouring spout forming insert 24′ is of a construction identical with the insert 24 in the form shown in FIGS. 1 to 5. It is positioned relative to the tear out or tear open area 26′ with the pull tab 54′ extending through the slit 32′ in the side wall panel 14′ and the center panel 50′ of the insert coinciding approximately with the tear out area 26′ which brings the spout side wall forming panels 48′ and 52′ into overlying relation with adjoining portions of the side wall panels 14′ and 16′, respectively (FIG. 8). This arrangement may be desirable with some products which may be of a character to offer more resistance to the movement of the spout side walls 48 and 52 when they initially lie on the inside face of the panel 14 since in the alternate arrangement the panel 52′ folds when the carton is set up and merely slides along the surface of the panel 16′ when the spout is opened and closed.

In the form of the carton illustrated in FIGS. 9 to 12, the basic carton structure 70 remains the same while the pouring spout forming insert 72 is modified and also the carton wall panel 74 on which it is mounted, with the relative position or location of the spout structure being the same as in the form shown in FIGS. 6 to 8. The carton side wall panel 74 (FIG. 9) has a single tear line 76 extending diagonally downwardly from the transverse slit 78 to the hinge line 80 between the side wall panel 74 and the adjoining side wall panel 82 and defines therewith the tear out area 84. The insert 74 may be cut, in multiples, with little waste, from a strip of stock material, as illustrated in FIG. 12. The inserts 72 are separated in the strip by generally transverse cutting lines 86 spaced longitudinally of the strip and each insert is scored or creased on the hinge forming line 88, which extends at an angle to the one side edge 90 and forms therebetween a triangular panel 92 with a pull tab extension 94. A curved or bowed edge portion 96 extends from the intersection with the score line 88 at one end thereof to an outwardly angled abutment or stop forming edge portion 98 at the other end thereof. The insert 72 is mounted on the inside face of the wall panel 74, as shown in FIG. 11, with the pull tab 94 extending through the slit 78 and the remainder of the insert lying on the inside face of the wall panel 74, with the insert panel 92 overlying the tear out area 84. The spout is opened by pulling outwardly on the pull tab member 94 so as to tear along the line 76 and swing the assembly about the hinge line 80 to the position shown in FIG. 10.

I claim:

1. A carton structure formed of paperboard or similar foldable sheet material which includes a pouring spout arrangement comprising a spout forming insert of like material disposed in the closed position on the inside face of a carton side wall forming panel, which insert includes an outer wall forming panel having an integral pull tab formation extending from the top end forming portion thereof and at least one side wall forming panel, and said carton side wall forming panel having at least one tear line extending upwardly near the top of the carton and disposed inwardly of a side edge and a transverse slit extending at the top end of said tear line, said tear line extending along one side of a carton side wall area which is of an extent corresponding approximately to the area of said outer wall forming panel of said spout forming insert, and said insert being positioned on the inside face of said carton wall with said wall panel lying flat against the inside face of said carton side wall panel and with said pull tab extending through said transverse slit in the carton side wall panel, and said outer wall forming panel of said insert being secured in overlying engagement with the carton side wall area which corresponds to the area of the outer wall forming panel of said spout forming insert, whereby, when said pull tab is pulled outwardly in a direction normal to the carton side wall, the side wall panel of said insert will fold so as to move into the opening resulting from the tearing of said carton side wall area on said tear line and the outward movement of said carton side wall area.

2. A carton structure as set forth in claim 1 wherein said carton side wall area lies along a hinge connection between said side wall panel and an adjoining carton side wall panel and said pour spout insert is formed of foldable sheet material with a hinge forming crease line which extends along one side edge of said outer wall forming panel and is aligned approximately with the tear line in said carton side wall forming panel so as to enable said insert to fold on said crease line.

3. A carton structure as set forth in claim 1 wherein said carton side wall area lies between a pair of laterally spaced tear lines in said carton side wall and said pour spout forming insert is initially secured in flat face engaging relation on the inside face of said carton side wall forming panel and in overlying relation to said tear lines.

4. In a carton structure formed of paperboard or similar foldable sheet material which comprises connected wall forming panel members, a pouring spout arrangement which includes a spout forming insert of foldable sheet material disposed on the inside face of a side wall forming panel member, said insert including an outer wall forming panel member with an integral pull tab forming member extending from the top end forming portion thereof and a side wall forming panel member at one side thereof which is separated therefrom by a hinge forming score line, said carton side wall forming panel member having a tear line disposed inwardly of a side edge thereof with a transverse slit extending at the top end of said tear line, said transverse slit and the associated tear line defining the top and one side, respectively, of a wall area which corresponds approximately to the area of said spout outer wall forming panel, said pull tab forming member extending through said transverse slit in the carton side wall forming panel member and said insert outer wall forming panel being secured to said carton side wall area and said hinge forming score line being approximately in alignment with said tear line so that by pulling on said pull tab in an outward direction generally normal to said carton side wall member said spout outer wall panel will hinge into open position and said spout side wall member will move with it by folding on said hinge forming score line.

5. In a carton structure as set forth in claim 4 wherein said tear line in said carton side wall member extends at an inward and upward angle relative to said carton side edge and defines with said carton side edge and said transverse slit a generally triangular area and wherein said outer wall forming panel member of said insert is triangular and corresponds generally to the triangular area in said carton side wall.

6. In a carton sructure as set forth in claim 4 wherein said tear line is generally parallel to said side edge of said carton panel member and is spaced therefrom and wherein said transverse slit extends laterally of said tear line to said side edge of said side wall forming panel member, said carton wall area and said insert outer wall forming panel member being arranged to swing outwardly and downwardly on a hinge line extending generally parallel with said transverse slit and at the bottom end of said tear line.

7. In a carton structure as set forth in claim 4 wherein said pour spout forming insert is positioned in part in flat engagement with said carton side wall forming panel member and in part in engagement with an adjoining carton side wall forming panel member.

8. In a carton as set forth in claim 4 wherein said tear line constitutes one of a pair of transversely spaced tear lines in said carton side wall forming panel member and said spout forming insert member comprises said outer wall forming panel member and adjoining side wall forming panel members which are positioned in flat engagement with the inside face of the carton side wall panel member and which side wall panel members of said spout hinge into parallel planes generally normal to the plane of the carton side wall forming panel member when said pull tab member is pulled outwardly in a direction away from said carton side wall and move into the resulting dispensing opening so as to form the spout side walls.

9. A carton structure formed of paperboard or similar foldable sheet material which includes connected wall forming panels and a pouring spout arrangement in one of said wall forming panels, said pouring spout arrangement comprising a spout forming insert disposed on the inside face of a carton side wall forming panel which insert includes a wall forming panel and a side panel hingedly connected thereto along one side thereof, said insert wall forming panel including an integral pull tab forming member extending from the top end forming portion thereof, said one side wall forming panel of said carton having a tear line spaced from a side edge thereof with a transverse slit extending transversely of the top end of said tear line, said tear line and said slit defining one side and the top, respectively, of a wall area of an extent corresponding approximately to the area of said wall forming panel of said spout forming insert, said insert being positioned with said pull tab forming member extending through said transverse slit in said carton side wall forming panel, said wall forming panel of said insert overlying said carton side wall area adjoining said tear line, and said insert being secured in flat engagement with said carton side wall panel whereby said insert wall forming panel will be hinged with said carton side wall area to an open position upon pulling outwardly of said carton side wall on said pull tab and the associated side wall panel of said spout will be hinged into spout side wall forming position.

10. A carton structure as recited in claim 9 wherein said pull tab member has a seal forming area extending outboard of said transverse slit for separable sealing relation with the confronting carton wall forming panel area adjoining said transverse slit.

* * * * *